US005503249A

United States Patent [19]

Virtamo et al.

[11] Patent Number: 5,503,249

[45] Date of Patent: Apr. 2, 1996

[54] PROCEDURE FOR CONTROLLING AN ELEVATOR GROUP

[75] Inventors: Jorma Virtamo, Espoo; Samuli Aalto, Helsinki, both of Finland

[73] Assignee: Kone Elevator GmbH, Baar, Switzerland

[21] Appl. No.: 318,511

[22] Filed: Oct. 5, 1994

Related U.S. Application Data

[63] Continuation of Ser. No. 57,840, May 7, 1993, abandoned.

[30] Foreign Application Priority Data

May 7, 1992 [FI] Finland ..... 922086

[51] Int. Cl.[6] ..... B66B 1/18

[52] U.S. Cl. ..... 187/382; 187/380

[58] Field of Search ..... 187/380, 382, 187/384, 387

[56] References Cited

U.S. PATENT DOCUMENTS

| | | | |
|---|---|---|---|
| 4,536,842 | 8/1985 | Yoenda et al. | 364/424 |
| 4,760,896 | 8/1988 | Yamaguchi | 187/124 |
| 4,802,557 | 2/1989 | Umeda et al. | 187/127 |
| 5,024,295 | 6/1991 | Thangavelu | 187/125 |
| 5,146,053 | 9/1992 | Powell et al. | 187/127 |
| 5,239,141 | 8/1993 | Tobita et al. | 187/124 |
| 5,260,527 | 11/1993 | Sirag, Jr. | 187/131 |

*Primary Examiner*—Peter S. Wong
*Assistant Examiner*—Robert Nappi

[57] ABSTRACT

A system and method for controlling an elevator group including several elevators and related call devices which controls each elevator in a manner determined by the calls entered and the existing control instructions. When the control system has to decide between two or more control alternatives, a systematic decision analysis is performed by studying the effects resulting from each alternative decision, the effects resulting from each alternative decision, the effects being estimated by simulating by a Monte-Carlo type method the future behavior of the elevator system in the case of each alternative decision. To carry out the simulation, realizations are generated at random for the unknown quantities associated with the current state of the elevator system and for new external future events, and a control decision is made on the basis of the results of the decision analysis.

24 Claims, 3 Drawing Sheets

PROCEDURE FOR CONTROLLING AN ELEVATOR GROUP

This application is a continuation of application Ser. No. 08/057,840 filed on May 7, 1993, now abandoned.

FIELD OF THE INVENTION

The present invention relates to a system and method of controlling an elevator bank including several elevators and related call devices including a control system which controls each elevator in a manner determined by the calls entered and the existing control instructions.

SUMMARY OF THE INVENTION

The purpose of the group control is to efficiently distribute the transport tasks among the elevators belonging to the same bank. The aim is to operate the elevators of the bank in an optimal manner to ensure that the service offered to the passengers is as efficient as possible. One objective is minimization of the average waiting time of the passenger's (the time from the passenger's arrival to the arrival of the elevator). Other criteria can also be used as a basis for control. Among the variables relevant to group control are the number of calls, the time of the day, and the target floors.

The group control system and method of the present application are based on a decision analysis which is performed each time an elevator arrives at a point where the system has to decide which alternative action (e.g. passing by or stopping at a given floor) to choose. The decision analysis involves studying the effects resulting from different alternative control actions by simulating the behavior of the system from the situation after the decision. In this manner, the elevator control is optimized on the basis of the information available. This information includes the positions and motional states of the elevators as well as the calls pertaining to the elevators. Moreover, the prevailing type and amount of traffic, i.e. the expected amount of traffic in different directions, can be deduced from weekly and daily traffic statistics. However, statistics cannot provide accurate information about individual arrival events during the actual period of time concerned by a decision.

The control of the elevators in an elevator bank must be optimized as much as possible. In making a control decision, the system and method of the present application take the effects resulting from the decision with respect to the selected optimization criterion into account, considering even probable future arrival events. To accomplish this, the invention includes, when the control system has to decide between two or more possible actions, a systematic decision analysis performed in real time, by studying the effects resulting from each alternative decision, said effects being estimated by simulating the future behavior of the elevator system in the case of each alternative decision using a Monte-Carlo type method, generating realizations at random for unknown quantities associated with the current state of the elevator system and for new external future events, and a control decision made on the basis of the results of the decision analysis. In a Monte-Carlo type simulation, unknown quantities relating to the decision situation are selected at random according to assumed distributions. When the system behavior is imitated by Monte-Carlo simulation, at each branching point the realization alternative of each branch is selected at random.

Other embodiments of the invention defined are by the features presented in the dependent claims.

The system and method of the present application produce optimal decisions for elevator group control in a systematic manner. The system and method are applicable in all traffic situations, enabling the same unique system to be used. Possible future changes, such as new calls and new customers, are taken into account when making a control decision. The system and method allow free selection as to the quantity or quantities to be considered in the optimization. The system and method of the present application can be easily applied to different elevator systems. The characteristics of each system, including the limitations imposed by the elevator cars, are considered in the operation of the system.

In the following, the invention is described in detail by the aid of one of its embodiments by referring to the drawings, in which

DESCRIPTION OF THE PREFERRED EMBODIMENT

Figure 1:
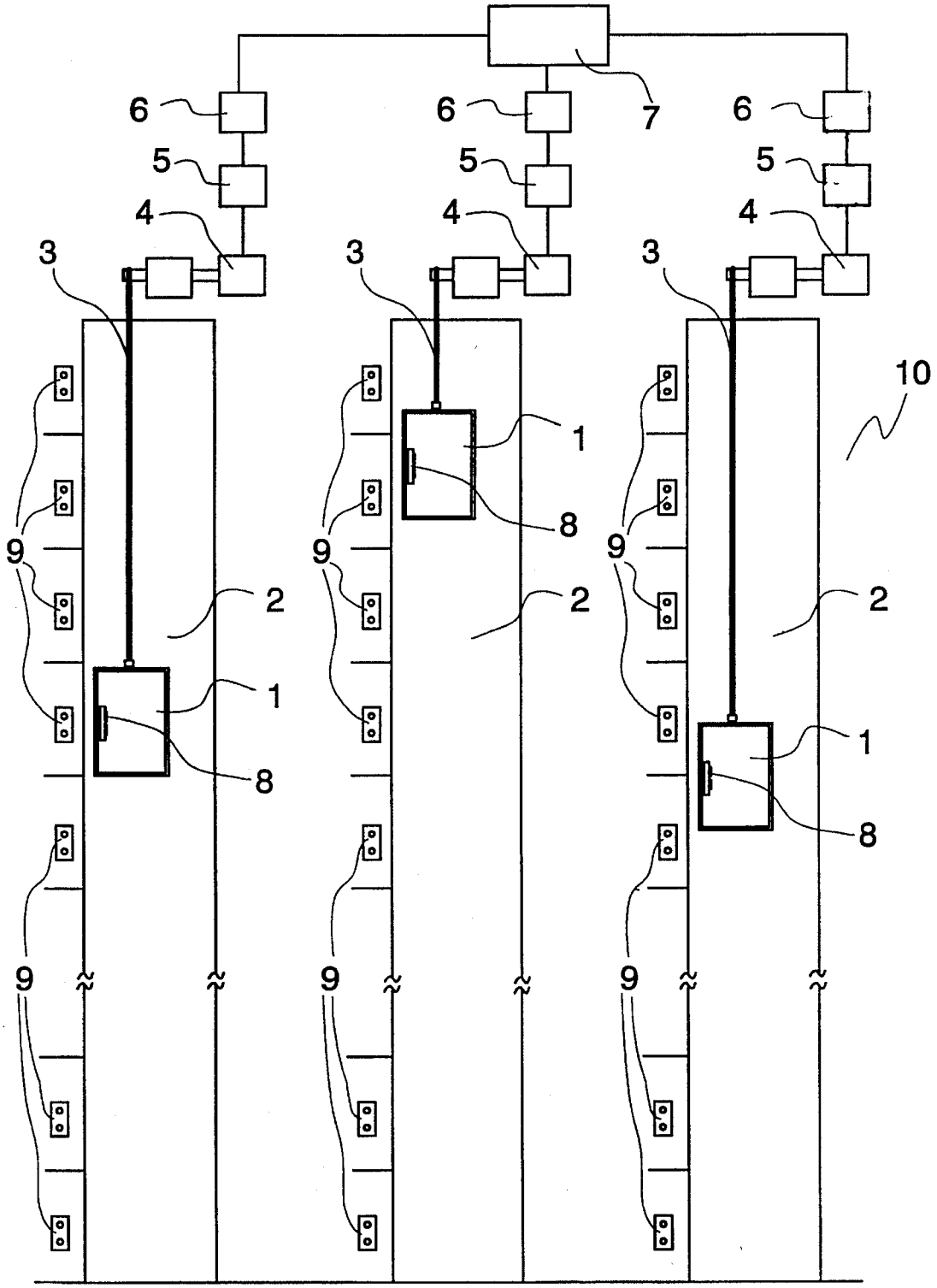
FIG. 1 is a diagram illustrating the elevator group system of the present application.

FIG. 1 presents a diagram illustrating an elevator group system 10 including three elevators, which can be controlled by the method of the present application. Each elevator car 1 moves in its shaft 2, suspended on hoisting ropes 3 and driven by a geared or gearless hoisting motor 4. The motor is controlled by a motor regulation unit 5 in accordance with commands received from the elevator control unit 6. The control unit 6 of each elevator is further connected to a group control unit 7, which distributes the control commands to the elevator control units 6. A group control unit 7 may also be placed in conjunction with one or more elevator control units 6. Fitted inside the elevator cars 1 are car call buttons 8 and possible displays for the transmission of information to the passengers. Similarly, the landings are provided with landing call buttons 9 with displays. For the control of the elevator group, the call buttons 8 and 9 and the corresponding displays are connected by a communication bus to the elevator control units 6 to transmit the call data to the elevator control unit 6 and further to the group control unit 7.

Decision points

In the control of an elevator, various points can be distinguished where the control system has to make a decision regarding the function to be carried out. In the following it is assumed that there are two decision points for an elevator: a point of dispatch, where the elevator is standing at a floor with doors closed and ready to depart, and a point of stopping, where the elevator is moving and arriving at the deceleration point of a floor.

An elevator standing at a point of dispatch with doors closed can depart either in the upward or the downward direction. If the elevator remains standing, it can open its doors and give either an upward or a downward direction indication. The elevator may also remain standing with doors closed. An elevator in motion may decide to pass by a given floor or to stop at the floor and give a downward or upward direction indication. However, not all alternatives are allowed in all situations, because there are certain marginal conditions imposed by other factors. For instance, a moving elevator has to stop at the floors determined by the car calls and it must not pass by those floors.

Stages of operation of an elevator

Figure 2:
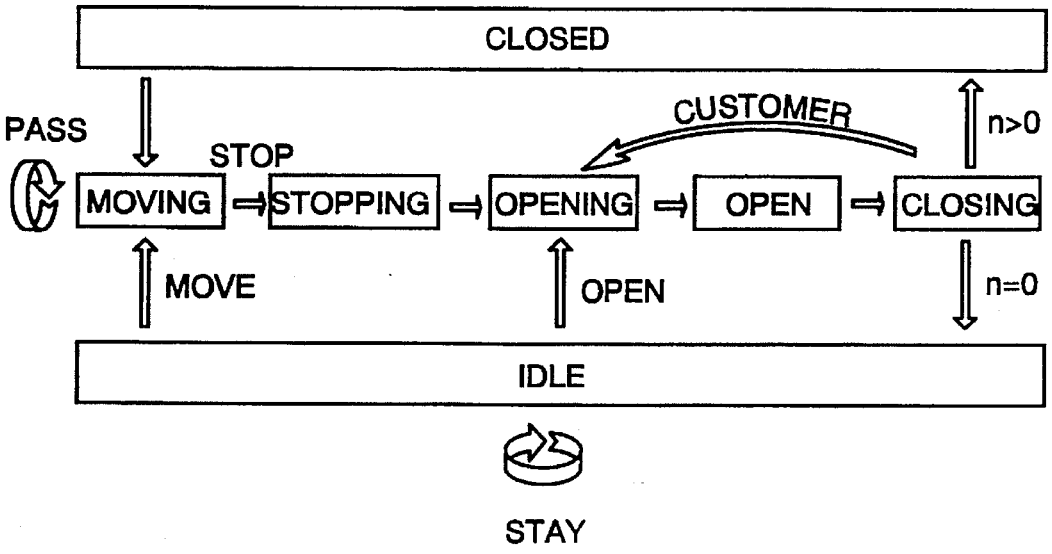
FIG. 2 illustrates the stages and alternatives of operation of an elevator at decision points.

At a decision point, the system makes a selection which initiates a new stage in the operation of the elevator. The diagram in FIG. 2 presents the operational stages as a model based on the decision situations described above. In this model, elevator operation is divided into seven stages. In the figure, the stages are represented by renctangle and the transition from one stage to another by arrows. The transitions take place either upon controlled decisions or automatically. In the IDLE stage, the elevator stands at a landing with doors closed, without passengers. In this stage, the system can choose between three different decisions for the elevator. Upon the decision STAY the elevator will remain where it is, upon the decision MOVE the elevator starts moving and enters the stage MOVING, and upon the decision OPEN the elevator opens its doors and enters the stage OPENING, during which the doors are opening. An elevator which is running, i.e. in the MOVING stage, can pass a floor with the decision PASS, and with the decision STOP it can enter the STOPPING stage, in which the elevator is stopping while the doors remain closed. From the STOPPING stage the elevator automatically passes into the OPENING stage.

In the OPENING stage the elevator is either stopping or has already stopped and the doors are opening. From the OPENING stage the elevator automatically passes into the OPEN stage, in which the doors are open. From the OPEN stage the elevator passes into the CLOSING stage, during which the doors are closing while the elevator remains stationary. From the CLOSING stage the elevator passes into the OPENING stage if a customer entering the elevator while the doors are closing causes them to reopen, and into the IDLE stage if the elevator is empty (number of customers n=0) or into the CLOSED stage if any customers are present in the elevator (n>0). In the CLOSED stage the elevator is stationary with doors closed and with customers in the car and passes into the MOVING stage when the elevator departs.

Internal simulator of group control

In the simulation model, two internal event points are distinguished: a stopping point and a loading point. A stopping point refers to the arrival of the elevator at the deceleration point of a floor. A loading point means a moment when one of the elevators is ready to receive a new customer.

Figure 3:
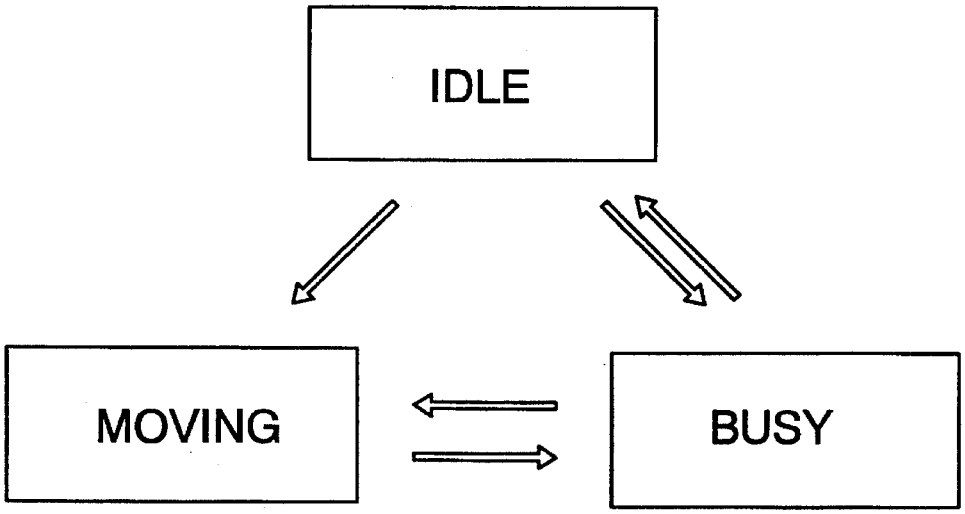
FIG. 3 presents the stages of operation of an elevator according to the description used in the internal simulator.

On the basis of the internal event points, elevator operation is divided into three stages as indicated by FIG. 3, by considering the next internal event point for the elevator. An elevator is in the IDLE stage if it has no next internal event point, in the MOVING stage if its next internal event point is a stopping point, and in the BUSY stage if its next internal event point is a loading point.

For an elevator in the MOVING stage there must always be a target floor, which determines the next stopping point, and for an elevator in the BUSY stage there must be a service direction, which determines whether the elevator is serving customers travelling downwards or those travelling upwards. The internal event points are completely unambiguously defined on the basis of the system parameters without any random or accidental factors.

The operational stage of an elevator can only be changed at an event point, and the new stage is determined on the basis of the system status and the so-called internal control used in the simulation. In FIG. 3, the following transitions between stages can be distinguished:

1. An IDLE elevator remains idle at least until the arrival of the next customer because no next internal event point has been defined for it. When a new customer generates a new call from a different floor and an idle elevator is sent to serve the call, the elevator enters the MOVING stage. In this case, the stopping point for the elevator will be the instant of arriving at the deceleration point of the floor corresponding to the new call, i.e. the target floor. If the new call is generated from the floor where the idle elevator is, the elevator opens its doors and enters the BUSY stage. In this case, the next service point is defined as the opening instant of the doors and the service direction is the direction of the call. In all other cases, the elevator remains idle, waiting for a call. In the above cases, the decisions regarding departure of the elevator and opening of the doors are made by the internal control system of the simulator.
2. When a MOVING elevator arrives at a stopping point, the system decides either to stop, in which case the elevator enters the BUSY stage, or to pass by the floor, in which case the elevator remains in the MOVING stage. In the case of a stopping decision, the actions between the event points of the elevator, i.e. between the loading and stopping points, includes stopping the elevator, opening the doors and unloading the car of passengers going to the floor in question. In the case of a pass-by decision, a new target floor determining the next sopping point is defined for the elevator. If a new call to a floor between the elevator and its target floor appears, the internal control system of the simulator decides whether the target floor and the corresponding stopping point defined for the elevator shall be changed or not. In this case, the operational stage of the elevator remains unchanged. The stopping and pass-by decisions and the selections of target floor are made by the internal control system of the simulator.
3. When a BUSY elevator arrives at a loading point and there are passengers waiting in the queue of its service direction, the first passenger in the queue enters the elevator car and possibly gives a new car call. In this case, the elevator remains BUSY in the same service direction. The time required for the passengers to enter determines the interval between event points from the loading point to the next loading point.

When there are no passengers waiting to enter, the elevator may go into any stage depending on the situation. If there are any passengers in the elevator, it will enter the MOVING stage. If the elevator is empty, the internal control system decides whether the elevator shall remain IDLE or enter the MOVING stage for parking or to serve landing calls, or whether it shall be BUSY in the other service direction. In determining the interval between event points, the system considers the times required for opening and closing the doors, photocell delays, departure delays and the times required for the elevator to travel to the target floors.

As for serving the landing calls, the internal control used in the simulation employs a collection priniciple. This means that a moving elevator picks up all landing calls in its service direction unless it already has a full load in the car. An elevator which becomes idle is sent to serve the nearest landing call. If no such call exists, the elevator is parked. The floors where elevators can be parked depend on the traffic situation.

Implementation of control

Figure 4:
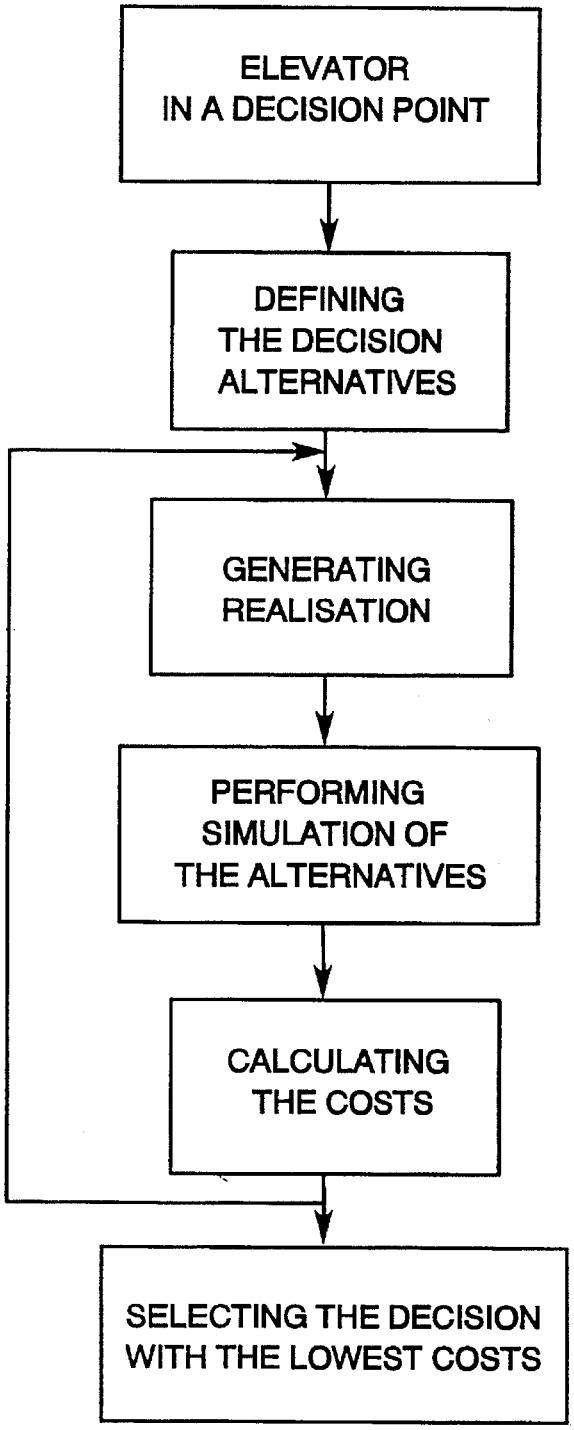
FIG. 4 presents a diagram illustrating the control method of the present application.

In the method of the present application, the steps shown in FIG. 4 are carried out. The group control system 10 of the elevator knows the basic facts relating to the elevators, such as the number of elevators, number of floors, elevator types and the closing and opening times of doors and the related delays. It also knows any functional features that are not to be decided even by an optimizing control procedure, such as fixed parking floors and zone divisions. In addition, the group control system 10 receives estimates of traffic flow for each floor, based on statistics and the date and time. As for landing calls, only the time of entry is assumed to be known. The number of passengers inside the elevator car is assumed to be known on the basis of the weight data obtained from the load-weighing device of the car.

When an elevator arrives at a decision point, the group control system 10 is informed about this via the elevator control system 10. The group control system has access to the status data of each elevator 1 in the bank, as well as to the landing call status data. The alternatives possible in a decision situation are defined by means of a computer in the group control unit 7 e.g. according to the operational model presented in FIG. 2. Since an elevator group contains several elevators, the alternative decisions possible for each elevator 1 must be considered. For example, if the group includes L elevators and each of these has c decision alternatives, the number of decision alternatives for the whole system 10 will be $m=c^L$. The real alternatives may vary greatly depending on the operating environment and the requirements applying in each case.

After the decision alternatives have been defined, a Monte Carlo simulation is performed whereby the computer selects at random a given number of different realizations for the unknown quantities of the decision situation, such as the numbers and target floors of the passengers behind the landing calls, as well as for new external events in the future, such as the times of arrival, floors of departure and destination floors of new passenger's. The selections are made on the basis of estimates of amounts of traffic based on statistics in the manner described in the next section.

In each round of random selections, after the realization has been determined, a simulation of the elevator system is performed. It will be advantageous to go through all the decision alternatives with the same realization to minimize the accidental errors occurring in the comparison of the advantages of each alternative. In the execution of the simulation, a given previously defined control policy, such as collection control, is observed in all the decision situations encountered. The simulation covers a length of time determined in advance.

After the simulation, the costs of each decision alternative are calculated. The target function to be minimized is e.g. the passenger's waiting time, travelling time or equivalent, or a combination of several factors, in which case it may also include quantities like the number of departures of elevators or the distance travelled by them. The cost of a decision alternative is the cumulative result of the selected cost function for the simulation period. After a preselected number of simulations have been performed, the alternative whose costs on the average are lowest is selected as the decision to be realized.

Monte Carlo Generation of realizations

Under a Monte Carlo approach, the arrivals of passengers on each floor are assumed to take place according to the Poisson process. Since there is always at least one passenger behind a call, the following formula applies:

$$P\{X=1+n\}=(\lambda t)^n/n!*e^{-\lambda t},$$

where $\lambda$ represents the intensity of arrivals of passengers travelling from the floor in question in the direction concerned and t is the length of time for which the call has been in effect. If some of the passengers behind the call have already entered the elevator, then the Poisson distribution must be made conditional with respect to the number $n_5$ of passengers having entered. In this case, the number of passengers still on the landing follows the distribution $$P\{X=1+n|X\geqq n_s\}=(\lambda t)^n/n!*\left[\sum_{j=n_s-1}^{\infty}((\lambda t)^j/j!)\right]^{-1}$$

when $n\geqq n_s\geqq 1$.

Similarly, it is necessary to random-select the destinations of the passengers behind the landing calls. The distribution of these destinations is determined by the amounts of traffic $\lambda_{ij}$ on each floor, the subscripts i and j referring to corresponding floors. The number of passengers going from floor i to floor j is obtained from the distribution $$P\{i\rightarrow j|i\uparrow\}=\lambda_{ij}/\Sigma\lambda_{ik}).$$

The distribution of the number of passengers travelling in the down direction is calculated in a corresponding manner. Also, the distribution of the passengers behind car calls is calculated similarly, but its exact value is not as important for the simulation.

According to the Poisson process assumption, the intervals between arrivals of new passengers are random-selected independently of each other from the exponential distribution. For new passengers, a floor of entry, direction and destination are also random-selected. New passengers are generated for a certain period from the time of decision onwards.

During the first round of selection, the quantities are not selected at random. Instead, it is preferable to assign them the most probable values in order to achieve a typical realization.

In the above, the invention has been described in reference to one of its embodiments. However, the presentation is not to be interpreted as constituting a restriction, but the embodiments of the invention may vary freely within the limits defined by the following claims. For example, decision situations realized within a short time from each other can be taken into account by considering combinations of these alternatives in connection with making a decision.

We claim:

1. A method of controlling an elevator system including an elevator group including several elevators and related call devices by controlling each elevator in a manner determined by calls entered and existing control instructions, comprising the steps of:

performing a real time systematic decision analysis to decide between two or more alternative actions and their resulting effects, said resulting effects being estimated by simulating in real time future behavior of the entire elevator system for each alternative action, for which Monte Carlo simulation realizations are generated using randomly generated numbers for unknown quantities associated with a current state of the elevator system and for new external future event, making a control decision to use one of the alternative actions based on the systematic decision analysis, and controlling the elevator group based upon the control decision.

2. The method of claim 1, wherein a number of different simulation realizations are generated for all unknown quantities associated with the current state of the elevator system and with the new external future events, and a simulation is performed separately for each simulation realization of each alternative action.

3. The method of claims 1 or 2, wherein the simulation realizations are generated based on estimated traffic intensities, said simulation realizations specifying a number of passengers having made landing calls and their corresponding destination floors, and a number of new passengers and their corresponding destination floor, departure floor, and time of arrival.

4. The method of claim 2, wherein subsequent control decisions are made in accordance with a given preselected control policy.

5. The method of claim 1 wherein the simulation employs a collection control policy.

6. The method of claim 1 wherein the systematic decision analysis is performed based on a result of a predefined target function.

7. The method of claim 1 wherein the control decision is selected by choosing an alternative action that yields a best average result.

8. The method of claim 6 or 7, wherein said method minimizes at least one of an average waiting time of passengers, an average travelling time of the passengers, an average number of calls in effect, a weighted combination thereof, and a weighed combination of the above features and a weighted combination of a number of departures of elevators per unit of time and an average number of moving elevators.

9. The method of claim 1 wherein interdependencies of action situations relating to different elevators but realized nearly simultaneously are taken into account by considering different combinations of possible action alternatives for each elevator.

10. The method of claim 1 wherein for each alternative action, the same simulation realizations are used for the unknown quantities.

11. The method of claim 1, wherein, for each alternative action, the same resulting effects are implemented for a predetermined length of time.

12. The method of claim 1 wherein a time of generation of events is a predetermined period of time from a moment of decision onwards.

13. A method for controlling an elevator system, comprising the steps of:

simulating in real time future behavior of the entire elevator system for a plurality of alternative actions by using randomly generated numbers to produce Monte Carlo simulation realizations corresponding to a current state of the elevator system and corresponding to new future external events, to generate resulting probabilistic effects for each of the plurality of alternative actions;

performing a real time, systematic, decision analysis to select one of the plurality of alternative actions and its corresponding resulting effects;

making a control decision to use one of the alternative actions for the elevator system based on the systematic decision analysis; and controlling the elevator group based upon the control decision.

14. The method of claim 13, wherein a number of different simulation realizations are generated for the current state of the elevator system and with the new external future events, and a simulation is performed separately for each simulation realization of each of the plurality of alternative actions.

15. The method of claims 13 or 14, wherein the simulation realizations are generated based on estimated traffic intensities, said simulation realizations specifying a number of passengers having made landing calls and their corresponding destination floors, and a number of new passengers and their corresponding destination floor, departure floor, and time of arrival.

16. The method of claim 14, wherein subsequent control decisions are made in accordance with a given preselected control policy.

17. The method of claim 13, wherein the simulation employs a collection control policy.

18. The method of claim 13, wherein the systematic decision analysis is performed based on a result of a predefined target function.

19. The method of claim 13, wherein the control decision is made by choosing one of the plurality of alternative actions that yields a best average result.

20. The method of claim 18 or 19, wherein said method minimizes at least one of an average waiting time of passengers, an average travelling time of the passengers, an average number of calls in effect, a weighted combination thereof, and a weighed combination of the above features and a weighted combination of a number of departures of elevators per unit of time and an average number of moving elevators.

21. The method of claim 13, wherein interdependencies of action situations relating to different elevators comprising said elevator system but realized nearly simultaneously, are taken into account by considering different combinations of possible action alternatives for each elevator.

22. The method of claim 13, wherein for each of the plurality of alternative actions, the same simulation realizations are used.

23. The method of claim 13 characterized in that, for each of the plurality of alternative actions, the same resulting effects are implemented for a predetermined length of time.

24. The method of claim 13, wherein a time of generation of events is a predetermined period of time from a moment of decision onwards.

* * * * *